US006104898A

United States Patent [19]

Awano et al.

[11] Patent Number: 6,104,898

[45] Date of Patent: Aug. 15, 2000

[54] ROTARY DEVELOPING DEVICE HAVING ADJUSTABLY MOUNTED DEVELOPING UNITS

[75] Inventors: Toyohiko Awano; Tetsuro Maeda; Shigeki Nishimura; Shigemasa Nakaya; Takeshi Fukuda; Katsumi Harumoto; Toshio Masubuchi, all of Iwatsuki, Japan

[73] Assignee: Fuji Xerox Co., Ltd., Tokyo, Japan

[21] Appl. No.: 09/373,981

[22] Filed: Aug. 16, 1999

[30] Foreign Application Priority Data

Aug. 28, 1998 [JP] Japan ..... 10-243546

[51] Int. Cl.[7] ..... G03G 15/01

[52] U.S. Cl. ..... 399/119; 399/126; 399/227

[58] Field of Search ..... 399/119, 227, 399/126

[56] References Cited

U.S. PATENT DOCUMENTS 4,743,938 5/1988 Ohno ..... 399/227
5,198,866 3/1993 Kimura et al. ..... 399/222
5,294,967 3/1994 Munakata et al. ..... 399/227

FOREIGN PATENT DOCUMENTS 5-241420 9/1993 Japan .
6-110293 4/1994 Japan .

*Primary Examiner*—Joan Pendegrass
*Attorney, Agent, or Firm*—Oliff & Berridge, PLC

[57] ABSTRACT

A rotary developing device which facilitates a positional adjustment of developing units and prevents the developing units from being shifted even when they are used for a long period. Pins protruding from a revolver are inserted into elongated holes formed in developing units so that developing units are held in such a manner that the developing units are movable relative to the revolver. By mounting a spacer between the elongated hole and the pin, the positional adjustment of the photosensitive drum and the tracking roller is completed. Furthermore, a plurality of spacers which differ in thickness are prepared and by merely selectively mounting an appropriate spacer, the position adjustment of the tracking roller is completed.

11 Claims, 9 Drawing Sheets

ROTARY DEVELOPING DEVICE HAVING ADJUSTABLY MOUNTED DEVELOPING UNITS

BACKGROUND OF THE INVENTION

1. Field of the Invention

The present invention relates to a rotary developing device in the field of an electrophotographic full color image forming apparatus.

2. Description of the Related Art

Three developing units in which developers (each containing toner and carrier) of three primary colors are filled respectively are mounted on the electrophotographic full color image forming apparatus. Alternatively, such an image forming apparatus may be further provided with another developing unit in which a black developer is filled. These developing units are arranged such that they face one or a plurality of photosensitive drums in an opposing manner. Image forming is carried out by visualizing or developing electrostatic latent images with a plurality of developers which are applied in sequence.

In general, in case downsizing and lowering of the cost of the device are emphasized, a mechanism is adopted where a revolver holding four developing units is arranged in the vicinity of a photosensitive drum and by rotating this revolver, respective developing units are moved in sequence to a position where these developing units face the photosensitive drum in an opposing manner and electrostatic latent images are visualized or developed with respective developing units.

In such a mechanism, tracking rollers which are mounted on developing rollers of the developing units coaxially come into contact with the surface of the photosensitive drum so as to hold the distance between the developing rollers and the photosensitive drum constant.

With such a construction, in case an impact which the tracking roller receives when it comes into contact with the photosensitive drum is large, a turbulence of image occurs. Accordingly, a method has been proposed to remove the tracking roller and to fix the developing units to the revolver using screws.

In this method, however, an adjustment of mounting positions of the developing units to the revolver (an adjustment of the distance of developing units relative to the photosensitive drum) becomes cumbersome. Furthermore, to eliminate changing of position of the photosensitive drum at the time of replacing the photosensitive drum, it is necessary to increase the rigidity of the device. Furthermore, the rigidity of the revolver must be increased to eliminate shifting of the developing units and slacking of screws due to a centrifugal force and hence, the mechanism becomes complicated thus the device becomes large-sized and requires considerable man-hours for the adjustment.

The present invention has been made in view of the above and it is an object of the present invention to provide a rotary developing device which facilitates the adjustment of positioning of the developing units, causes no shifting of the developers even after the use of a long period and has a simple mechanism.

The foregoing and other objects and novel features of the present invention will be made clear hereinafter in view of the description of the specification and attached drawings.

SUMMARY OF THE INVENTION

According to the first aspect of the present invention, tracking members which are mounted on the end of a developing member come into contact with a photosensitive body so as to hold the distance between the developing member and the photosensitive body constant. Here, an electrostatic latent image formed on the photosensitive body is visualized or developed by the developing member mounted in the developing unit. A plurality of developing units are held by a revolver and corresponding to the rotation of the revolver, the developing units face the photosensitive body in an opposing manner in sequence to form a multicolor image.

On the other hand, the developing unit is held by holding means in such a manner that it is movable in an approximately radial direction of the revolver and the position that the tracking member starts its contact with the photosensitive body is adjusted by an adjusting member mounted on the holding means.

Due to such a construction, without using screws, an amount of extension or protrusion of the tracking member can be readily adjusted.

According to the second aspect of the present invention, the adjustment member is replaceably mounted on the holding means and hence, the adjustment means can be readily replaced.

According to the third aspect of the present invention, the mounting or dismounting position of the adjustment member is set to the replacement position of a toner cartridge. Accordingly, it is unnecessary to provide a mounting opening or the like for mounting the adjustment member separately and furthermore a large working area is assured and hence, mounting and dismounting operations are facilitated.

According to the fourth aspect of the present invention, the holding means comprises a support member which protrudes from the revolver or the developing unit and an elongated hole formed in either the developing unit or the revolver for allowing an insertion of the support member thereinto, while the adjustment member is constituted by a spacer which is mounted between the elongated hole and the support member so as to define the distance between the elongated hole and the support member.

Namely, by inserting the support member into the elongated hole, the developing unit is held in such a manner that it is movable relative to the revolver. By mounting the spacer between the elongated hole and the support member, the distance between the elongated hole and the support member is defined and hence, the positioning adjustment between the developing unit and the photosensitive body, namely, the positioning adjustment between the photosensitive body and the tracking member is completed.

According to the fifth aspect of the present invention, a plurality of spacers which differ in thickness are provided. Using such spacers, by merely mounting the suitable spacer, the positioning adjustment between the photosensitive body and the tracking member is completed.

According to the sixth aspect of the present invention, the thickness of the spacers can be determined while being mounted on the holding means. Accordingly, while confirming the contact condition between the photosensitive body and the tracking member, which spacer (thick one or thin one) should be replaced can be instantly determined.

According to the seventh aspect of the present invention, the spacer is provided with an elastically deformable pawl piece which is engaged with the developing unit and hence, the spacer can be surely fixed between the elongated hole and the support member. Furthermore, because being elastically deformable, the pawl piece can be engaged with the developing unit in a snap-fit manner and can be easily disengaged by deflecting it with a jig.

According to the eighth aspect of the present invention, the spacer is provided with a peripheral wall which comes into contact with and surrounds the outer peripheral portion of the elongate hole. Due to such a construction, the spacer is prevented from being shifted and even when the developing unit is used for a long period, the developing unit is prevented from being shifted from the fixed position.

DESCRIPTION OF THE PREFERRED EMBODIMENTS

The construction of the present invention is hereinafter explained in view of an embodiment.

Figure 1:
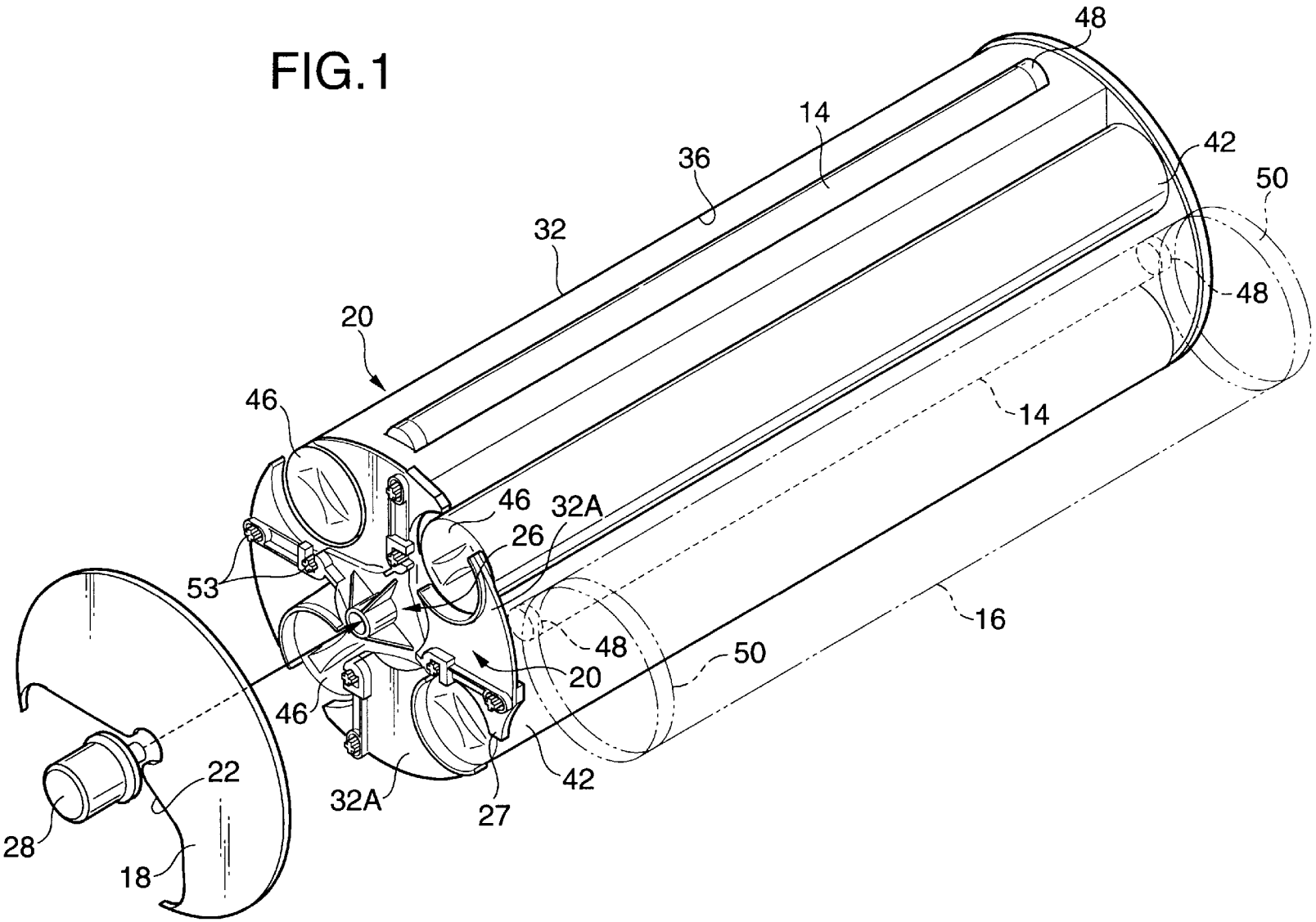
FIG. 1 is a perspective view showing developing units and spacers of a rotary developing device of the present invention.
Figure 2:
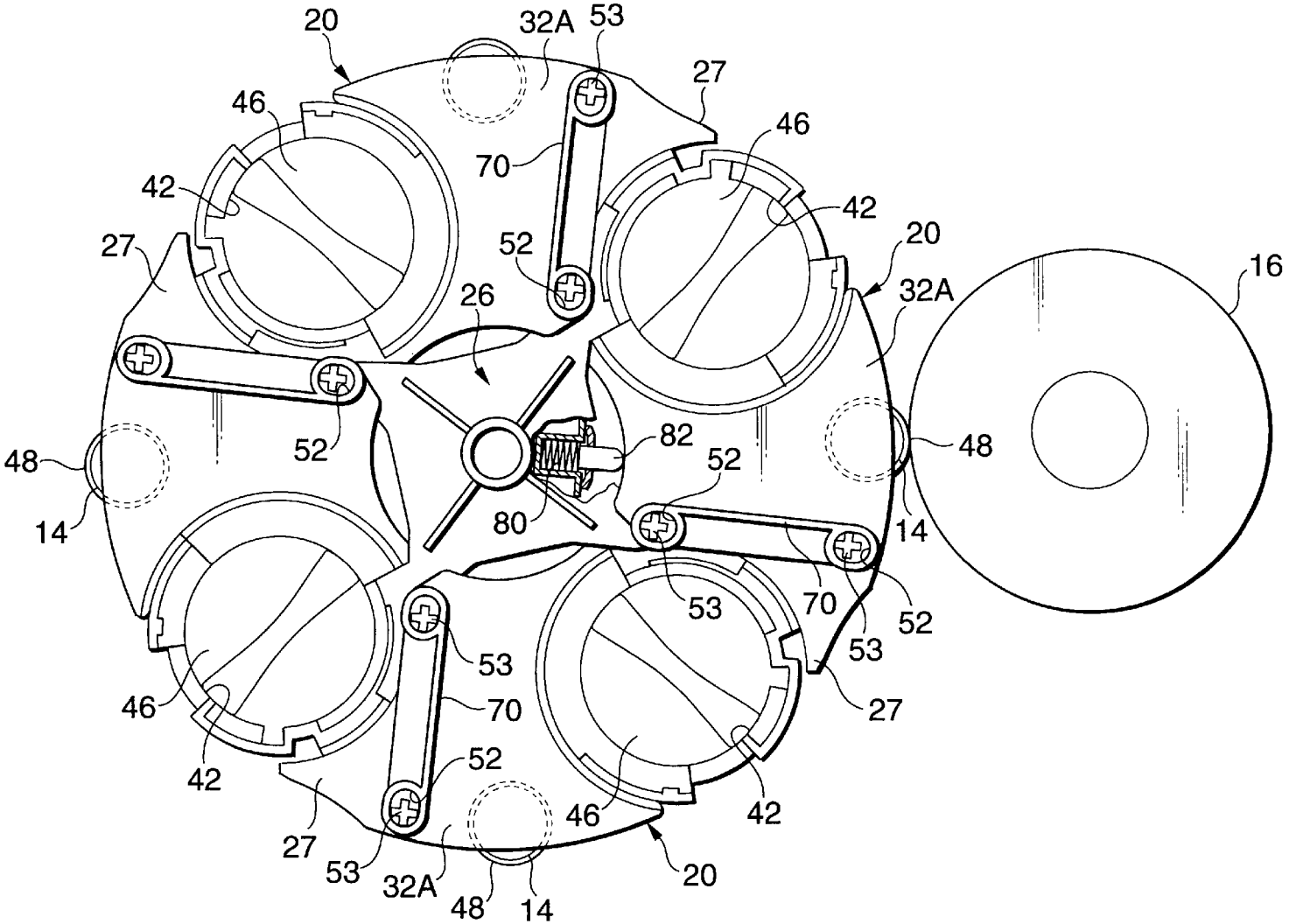
FIG. 2 is a side view showing the relationship between developing units and a photosensitive drum of the rotary developing device of the present invention.
Figure 7:
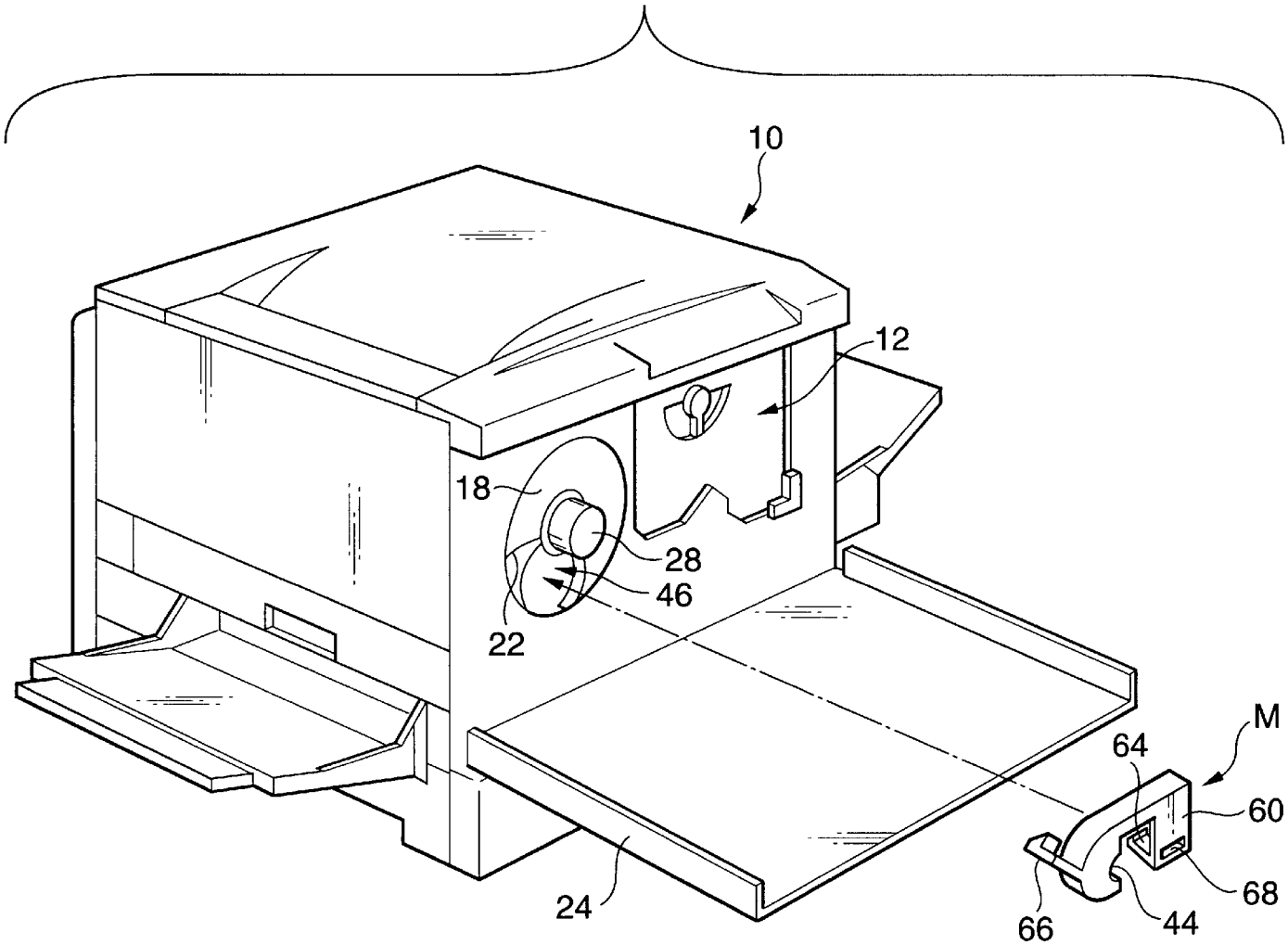
FIG. 7 is a perspective view of an image forming apparatus on which the rotary developing device of the present invention is mounted.

As shown in FIG. 1 and FIG. 7, a rotary developing device mounted on an image forming apparatus 10 is provided with a photosensitive unit 12 which includes a photosensitive drum 16. Along the side of the photosensitive drum 16, an approximately cruciform revolver 26 is disposed.

On arms 27 of the revolver 26, developing units 20 which contain developers or developing agents, in which toner and carrier are premixed, assigned respectively to C(cyan), M(magenda), Y(yellow), BK(black) are mounted, wherein developing rollers 14 which will be described later are exposed at a position where they face the photosensitive drum 16 in an opposing manner.

The photosensitive drum 16 is electrified by an electrification roller and then is exposed to laser beams which work as read elements so as to form an electrostatic latent image. This electrostatic latent image is developed or visualized in full colors by making the developing rollers 14 face the photosensitive drum 16 in an opposing manner in sequence along with the rotation of the revolver 26.

On the other hand, as shown in FIG. 2 to FIG. 5, in a side plate 18 of the revolver 26, a take-out opening 22 which is large enough to pull out the toner cartridge 46 is formed. As shown in FIG. 7, this take-out opening 22 is formed at the side of a front cover 24 and a toner cartridge 46 can be mounted or dismounted by removing the front cover 24. Furthermore, a spacer 44 which will be described later can be mounted or dismounted by making use of this take-out opening 22.

Furthermore, on the shaft portion of the revolver 26, a rotary knob 28 is mounted at the side of the front cover 24. After gripping this rotary knob 28, the revolver 26 can be rotated manually and hence, any arbitrary developing unit 20 can be moved to the take-out opening 22.

On the other hand, the developing unit 20 is provided with an elongated case 32 in which the developer is filled. On a side plate 32A of the case 32, the developing roller 14 is rotatably pivoted and is driven by a gear mechanism mounted on a shaft portion although not shown in the drawings.

The developing roller 14 has a portion of an outer peripheral surface thereof exposed through an opening portion 36 of the case 32. Furthermore, between the peripheral portion of the opening portion 36 and the developing roller 14, a given gap is formed and hence, the developing roller 14 can be rotated with the developer adhered to the developing roller 14.

Due to such a construction, the developing roller 14 absorbs carrier contained in the developer and forms a magnetic brush and supplies toner absorbed in the carrier to the photosensitive drum 16 whereby the electrostatic latent image of the photosensitive drum 16 is visualized or developed.

On the case 32, a cylindrical casing 42 is mounted. Upon mounting the toner cartridge 46 to this casing 42, the developer is supplied to the inside of the case 32 through the take-out opening formed in the casing 42.

Furthermore, on both end portions of the developing roller 14, tracking rollers 48 which have a diameter slightly larger than that of the developing roller 14 are mounted coaxially. These tracking rollers 48 come into contact with tracking portions 50 provided to both ends of the photosensitive drum 16 and form a given gap between the photosensitive drum 16 and the developing roller 14.

Furthermore, the side plate 32A of the case 32 is provided with two elongated holes 52 which extend in a radial direction of the revolver 26. Cruciform pins 53 which are protruded from the arm 27 are inserted in these elongated holes 52 and hence, the developing unit 20 is held in such a manner that the developing unit 20 can be slid in a radial direction of the revolver 26.

Still furthermore, a spring 80 is disposed at the central portion of the revolver 26 and a pin 82 biased by the spring 80 pushes the developing unit 20 in a radially outward direction. Accordingly, the tracking rollers 48 are brought into contact with the photosensitive drum 16 at a given pressure.

Figure 4:
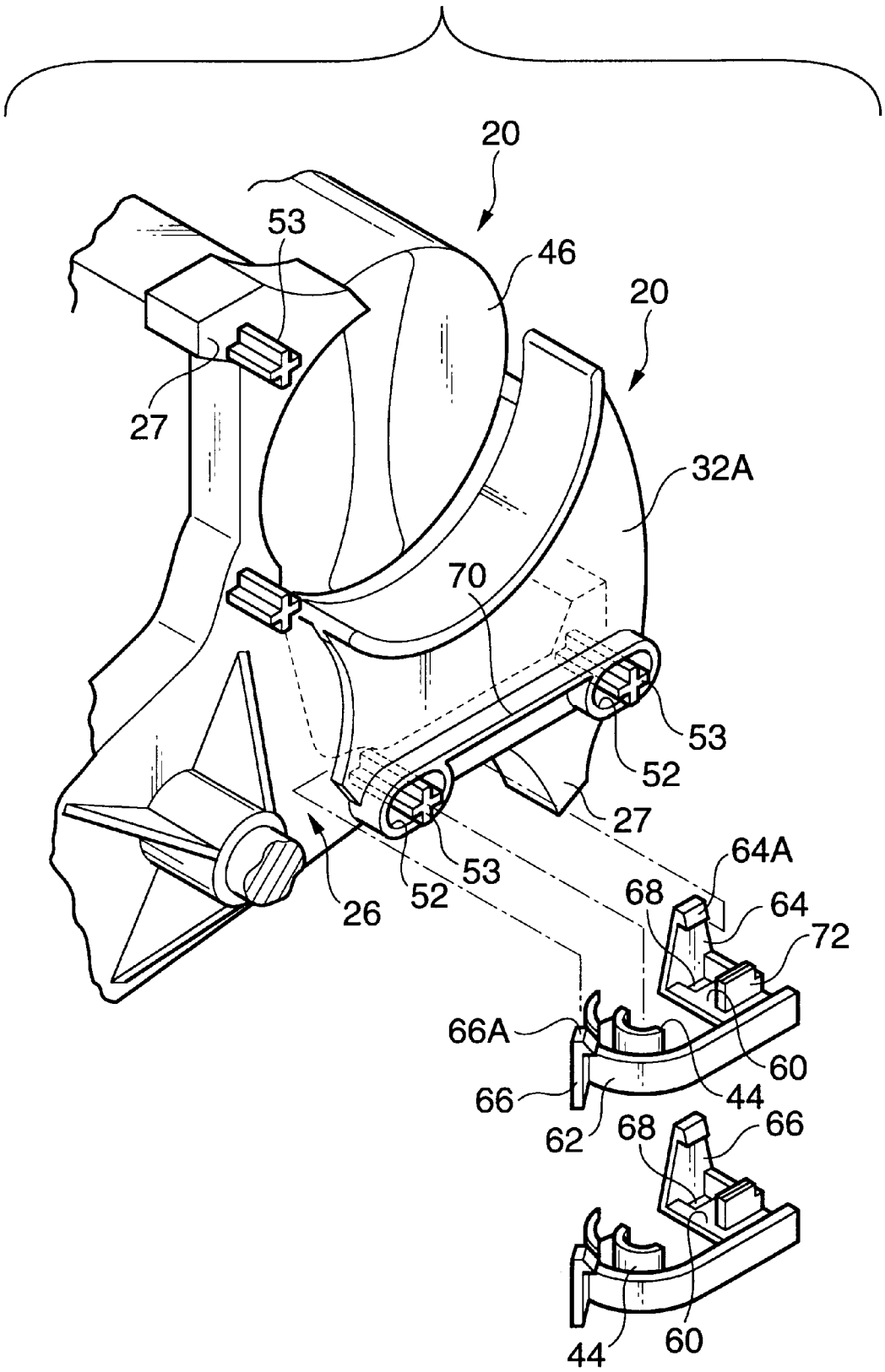
FIG. 4 is a perspective view of the spacer before being mounted on the developing unit.
Figure 5:
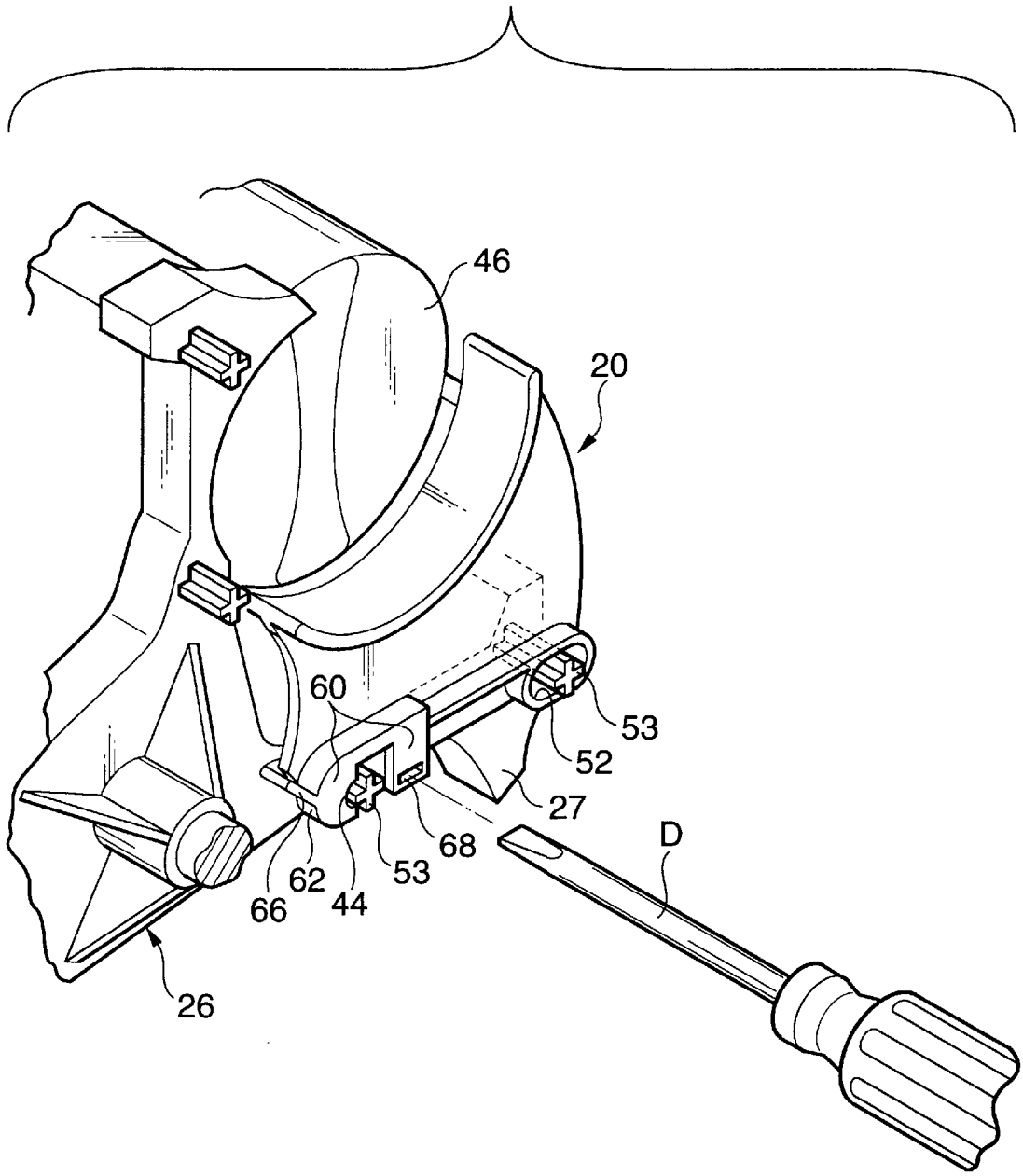
FIG. 5 is a perspective view of the spacer after being mounted on the developing unit.

Still furthermore, as shown in FIG. 4 and FIG. 5, between a hole wall 52A of the elongated hole 52 at the side of the central portion and a pin 53, the spacer 44 formed in one of halves of a cylindrical body is inserted. The spacer 44 has an outer peripheral surface thereof come into contact with the hole wall 52A and the inner peripheral wall thereof come into contact with the pin 53 thus defining a distance between the elongated hole 52 and the pin 53 (see FIG. 6).

Namely, by interposing the spacer 44 between the elongated hole 52 and the pin 53, the position between the developing unit 20 and the photosensitive drum 16 is defined. In other word, the positional relationship between the photosensitive drum 16 and the tracking roller 48 is adjusted.

Figure 8:
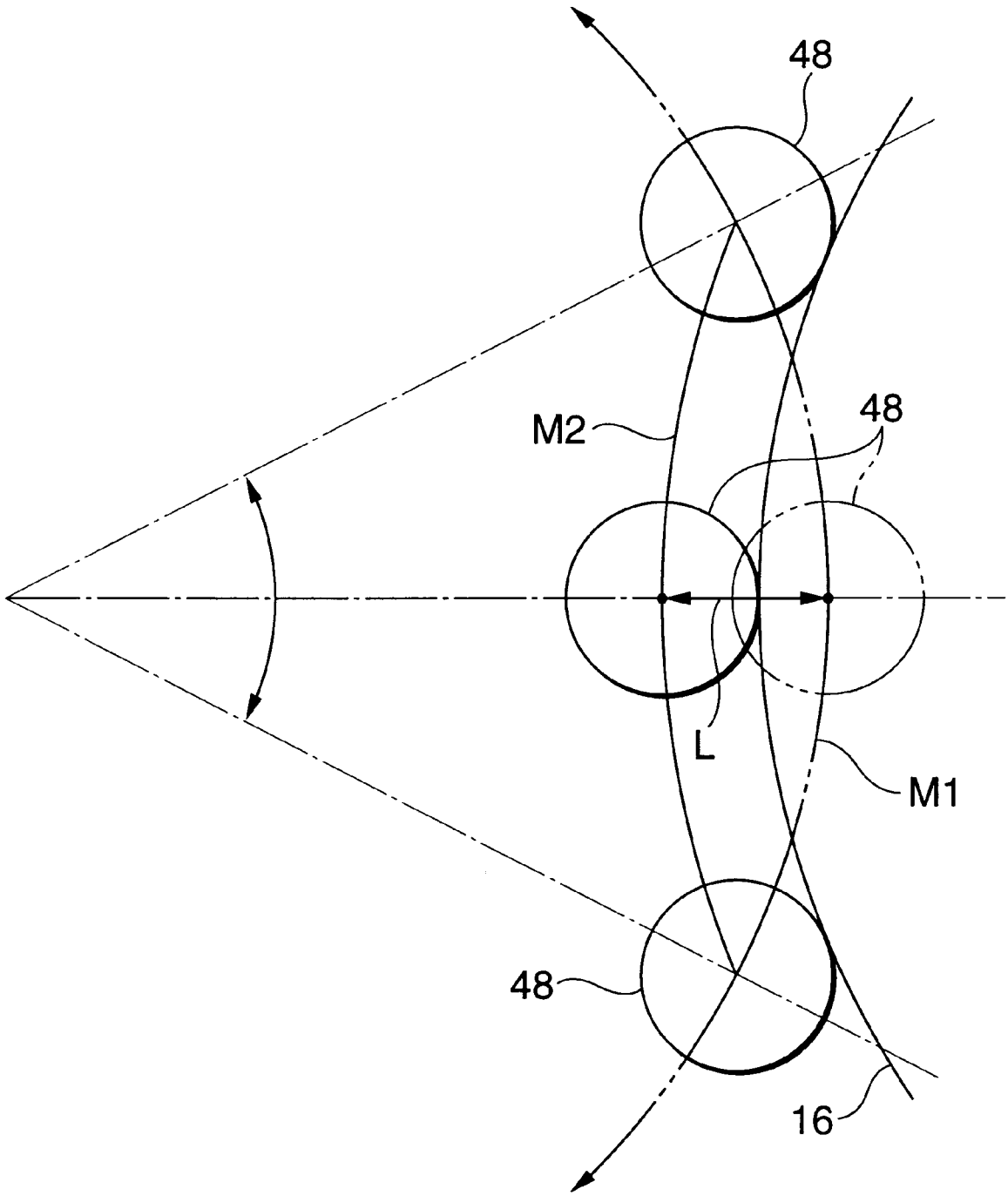
FIG. 8 is an explanatory view showing the relationship between an amount of overlapping between the photosensitive drum and the tracking roller.

Due to such a construction, as shown in FIG. 8, an amount of overlap L of the tracking roller 48 can be adjusted. Here, the amount of overlap L means a distance gap between a locus M1 of the tracking roller 48 when the photosensitive drum 16 is not present and a locus M2 of the tracking roller 48 when the tracking roller 48 comes into contact with the photosensitive drum 16 on radial extensions of the revolver 26 and the photosensitive drum 16. The result of an experiment shows that in case the amount of overlap L is equal to or below 0.3 mm, an impact which the photosensitive drum 16 receives is small and there is no irregularity of color.

Furthermore, a substrate 60 on which protruding spacers 44 are mounted has a central portion thereof including the elongated hole 52 cut out so as not to impede the movement of the developer unit 20 (elongated hole 52). From the outer peripheral portion of the substrate 60, a rib 62 which surrounds the outer peripheral portion of the elongated hole 52 droops.

Figure 6:
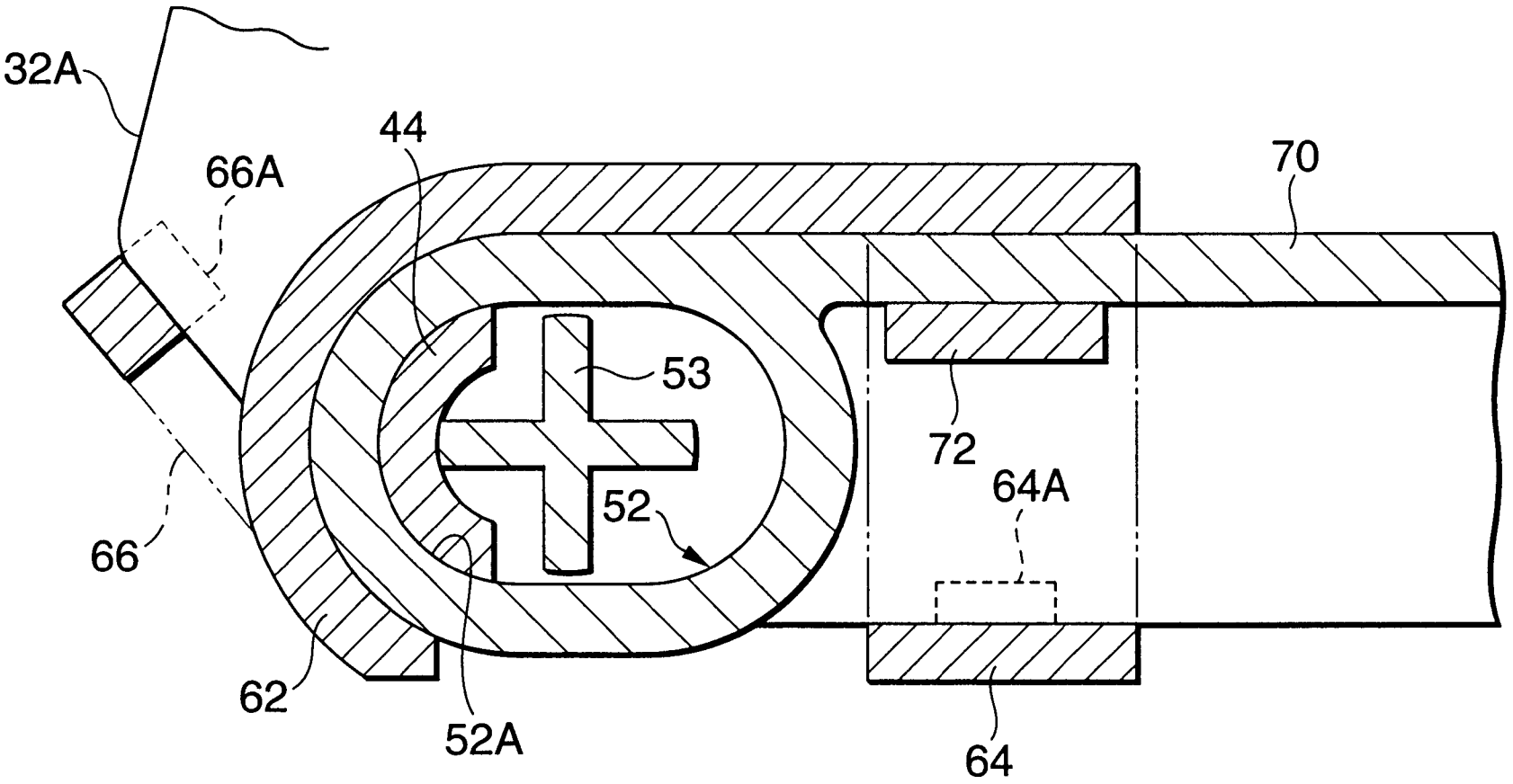
FIG. 6 is a planar cross-sectional view of the spacer mounted on the developing unit.

In this manner, by surrounding the outer peripheral portion of the elongated hole 52 with the rib 62 (the elongate hole 52 being partially sandwiched by the spacer 44 and the rib 62), the spacer 44 is prevented from being shifted and even when the developing unit 20 is used for a long period, the developing unit 20 is prevented from being shifted from the fixed position. The peripheral portions of two elongated holes 52 are united by an elongated wall 70 and as shown in FIG. 6, the elongated wall 70 has both sides thereof clamped by the ribs 62 and stopper walls 72 mounted on the rear surface of the substrate 60 thus preventing the spacer 44 from being shifted.

Furthermore, to the right side of the substrate 60, an elastically deformable pawl piece 64 which extends downwardly is provided. A pawl portion 64A which is formed on the distal endportion of the pawl piece 64 enters and is engaged with a corner of the rear surface of the side plate 32A in a snap-fit manner. To the left side of the substrate 60, an elastically deformable pawl piece 66 which extends in an oblique and downward direction is provided. A pawl portion 66A which is formed on the distal end portion of the pawl piece 66 enters and engages with a corner of the rear surface of the side plate 32A in a snap-fit manner.

Due to such a construction, the spacer 44 is surely mounted on the developing unit 20 so that even when an impact is applied to the device, the disengagement thereof can be prevented.

At the right side of the substrate 60, a rectangular hole 68 is formed. The engaged condition of the pawl portion 64A is readily released by inserting a driver D through this rectangular hole 68 and thereafter deflecting the pawl piece 64 outwardly.

As shown in FIG. 7, numeral M which shows the plate thickness of the spacer 44 which is marked on the substrate 60 so that a user can readily determine which size the spacer 44 to be replaced should be, while confirming the contact condition between the photosensitive drum 16 and the tracking roller 48.

The manner of adjusting the positions of the developing units and the photosensitive drum is hereinafter explained.

As shown in FIG. 7, after opening the front cover 24, through the take-out opening 22, the spacer 44 is mounted on the developing unit 20 which is in turn mounted on the revolver 26. In this manner, making use of the take-out opening 22, mounting and dismounting of the spacer 44 are facilitated.

Figure 3:
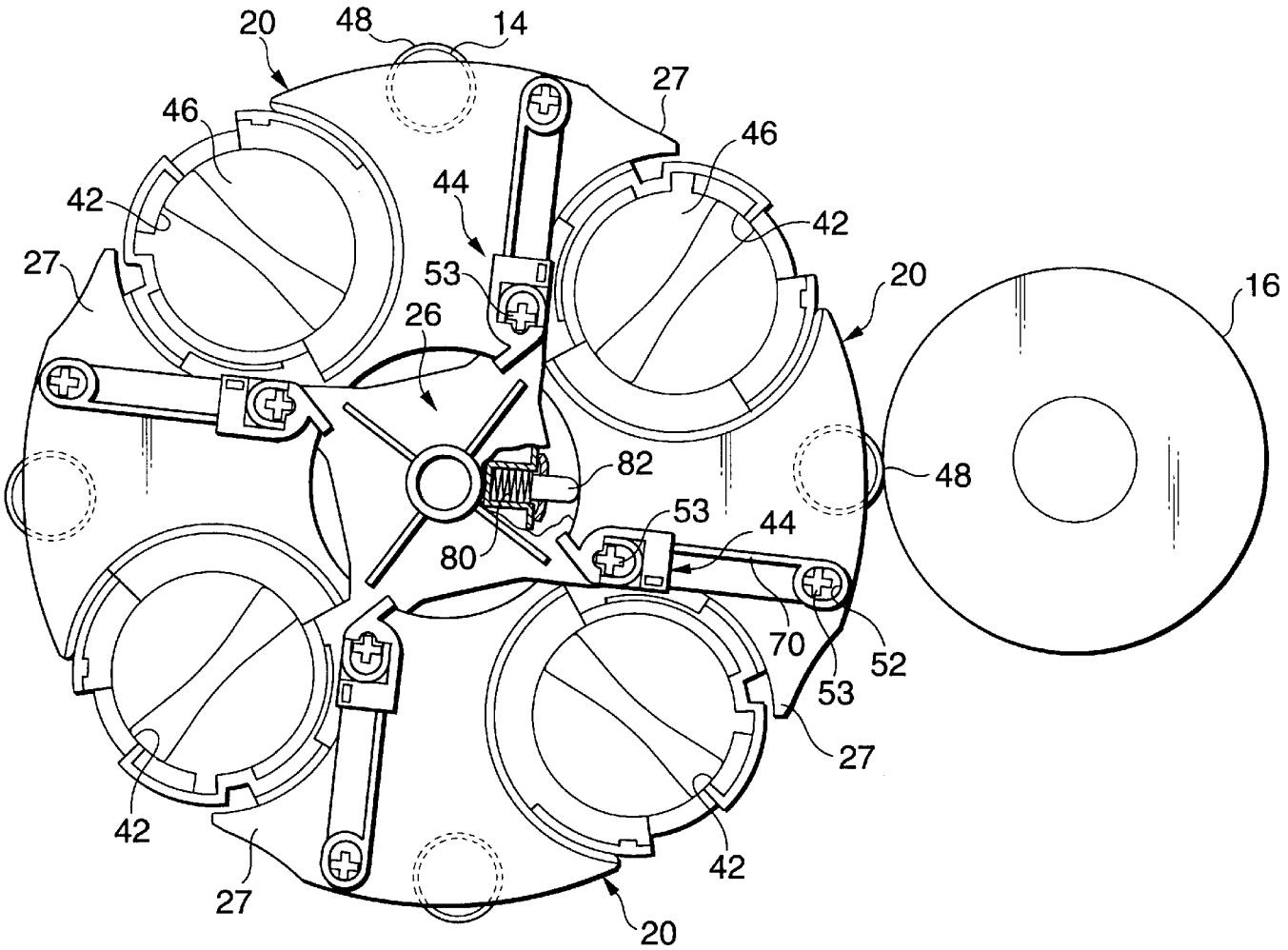
FIG. 3 is a side view showing a condition where spacers are mounted on the developing units of the rotary developing device of the present invention.

Subsequently, while confirming the contact condition between the photosensitive drum 16 and the tracking roller 48, as shown in FIG. 3, spacers 44 of appropriate size are respectively chosen and are respectively replaced corresponding to respective developing units 20. Namely, the conventional fixing of the developing units 20 to the revolver 26 with screws is no more necessary so that the adjustment operation can be carried out speedily.

Hereinafter, a method for judging or determining whether the amount of overlap between the photosensitive drum 16 and the tracking roller 48 is appropriate or not is explained.

This determination method is based on the observation of an amount of drag between the tracking roller and the photosensitive drum. Namely, when the tracking roller comes into contact with the photosensitive roller, the tracking roller is rotated and hence, a marking is made on the tracking roller and then the revolver is rotated to observe the amount of drag of the tracking roller.

It was found there is a relationship that in case the amount of overlap is 0.1 mm, the amount of drag is 3.0 mm, while in case the amount of overlap is 0.3 mm, the amount of drag is 5.0 mm. From this result, it is safe to say that the spacer having the amount of drag in a range of 3.0 mm–5.0 mm is appropriate.

Figure 9:
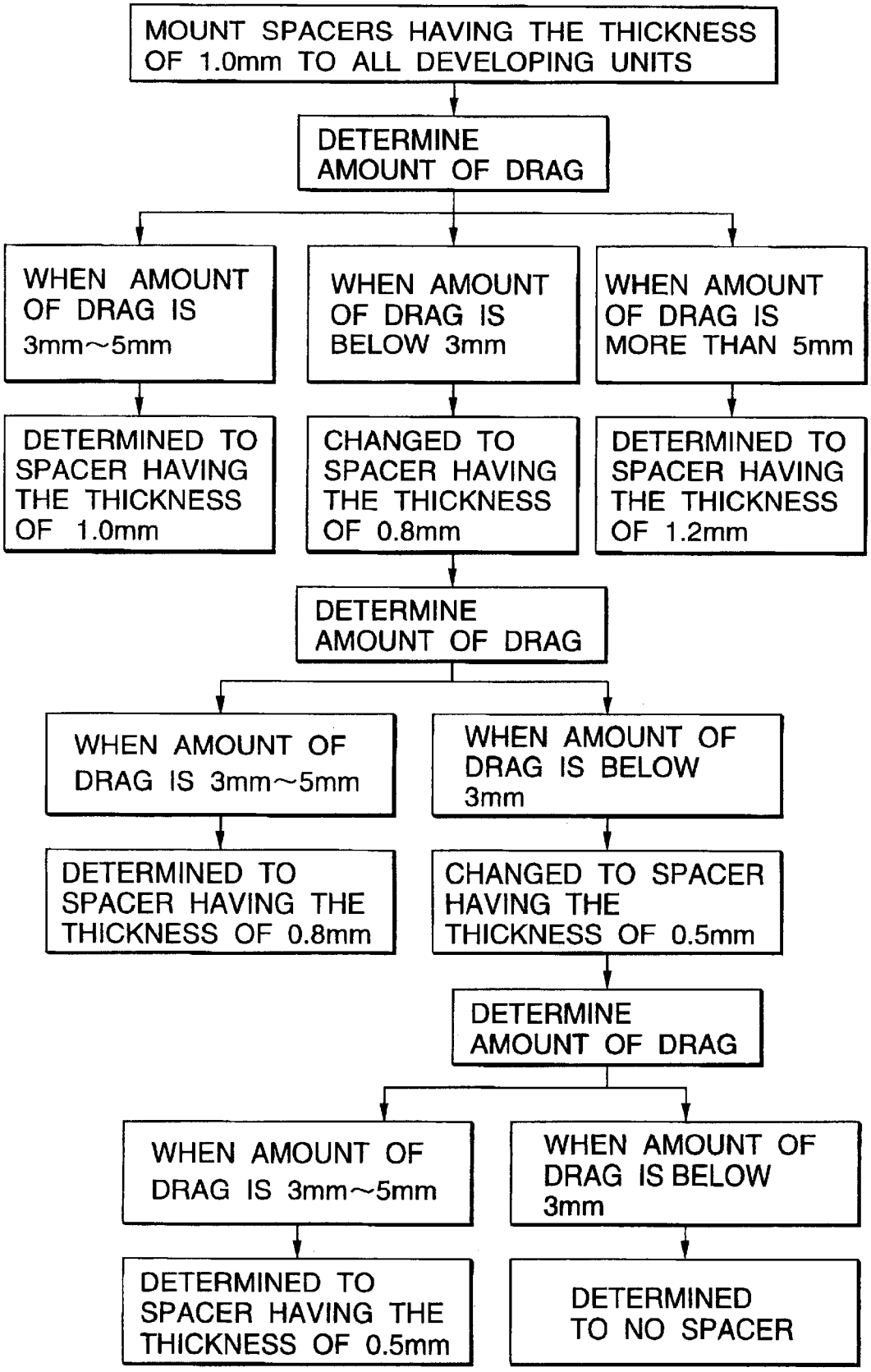
FIG. 9 is operational steps showing a manner of selecting spacers.

Here, as shown in FIG. 9, in an actual method for selecting spacers, first of all, the spacers having the thickness of 1.0 mm is mounted. Subsequently, the amount of drag of the tracking roller is measured. If the amount of drag is in a range of 3.0 mm–5.0 mm, the spacer having the thickness of 1.0 mm is determined.

Furthermore, when the amount of drag is more than 5.0 mm, the spacer having the thickness of 1.2 mm is determined. Furthermore, when the amount of drag is below 3.0 mm, it is replaced with the spacer having the thickness of 0.8 mm and the amount of drag is measured.

Here, if the amount of drag is in a range of 3.0 mm to 5.0 mm, the spacer having the thickness of 0.8 mm is determined. If the amount of drag is below 3.0 mm, it is replaced with the spacer having the thickness of 0.5 mm and the amount of drag is measured.

If the amount of drag is in a range of 3.0 mm to 5.0 mm, the spacer having the thickness of 0.5 mm is determined and if the amount of drag is below 3.0 mm, the spacer is not mounted.

In this manner, the size of the spacers is determined by the relationship between the amount of overlap and the amount of drag.

With the construction which have been mentioned heretofore, according to the invention as called for in the first aspect, the amount of protrusion of the tracking member can be readily adjusted without using screws. According to the invention as called for in the second aspect, the adjustment member can be readily replaced. According to the invention as called for in the third aspect, it is unnecessary to provide separately a mounting opening or the like for mounting the adjustment member and a large working area is assured so as to facilitate mounting and dismounting operations.

According to the invention as called for in the fourth aspect, the spacer is mounted between the elongated hole and the supporting member and hence, the distance between the elongated hole and the supporting member is defined thus completing the positional adjustment of the developers and the photosensitive body.

According to the invention as called for in the fifth aspect, by merely selectively mounting an appropriate spacer, the positional adjustment between the photosensitive body and the tracking member can be completed. According to the invention as called for in the sixth aspect, while confirming the contact condition between the photosensitive body and the tracking member, which spacer (thick one or thin one) should be replaced can be promptly determined.

According to the invention as called for in the seventh aspect, the spacer is surely fixed between the elongated hole and the supporting member. Furthermore, since the pawl piece is elastically deformable, the pawl piece can be engaged with the developing unit in a snap fit manner and can be readily disengaged by deflecting the pawl piece using the jig. According to the invention as called for in the eighth aspect, the spacer is prevented from being shifted and even when the developing unit is used for a long period, the developing unit is prevented from being shifted from the fixed position.

What is claimed is:

1. A rotary developing device comprising:

a plurality of developing units, each developing unit including a developing member that develops an electrostatic latent image formed on a photosensitive body and tracking members located on ends of the developing member that come into contact with the photosensitive body to make a distance between the developing member and the photosensitive body constant;

a revolver that rotates while holding the plurality of developing units;

holding means for adjustably holding the plurality of developing units on the revolver so that the plurality of developing units are movable relative to the revolver in an approximately radial direction of the revolver; and adjustment members that are replaceably mounted on the holding means and that adjust positions where the tracking members start contacting with the photosensitive body.

2. A rotary developing device according to claim 1, wherein a mounting and dismounting position of the adjustment members is located at a replacement position of a toner cartridge of the plurality of developing units.

3. A rotary developing device according to claim 2, wherein:

the holding means comprises a support member that protrudes from one of the revolver and the developing units, and an elongated hole formed in the other of the revolver and the developing units and through which the support member is inserted; and each of the adjustment members includes a spacer mounted between the elongated hole and the support member to define a distance between one end of the elongated hole and the support member.

4. A rotary developing device comprising:

a plurality of developing units, each developing unit including a developing member that develops an electrostatic latent image formed on a photosensitive body and tracking members located on ends of the developing member that come into contact with the photosensitive body to make a distance between the developing member and the photosensitive body constant;

a revolver that rotates while holding the plurality of developing units;

holding means for adjustably holding the plurality of developing units on the revolver so that the plurality of developing units are movable relative to the revolver in an approximately radial direction of the revolver; and adjustment members that are mounted on the holding means and that adjust positions where the tracking members start contacting with the photosensitive body;

wherein a mounting and dismounting position of the adjustment members is located at a replacement position of a toner cartridge of the plurality of developing units.

5. A rotary developing device comprising:

a plurality of developing units, each developing unit including a developing member that develops an electrostatic latent image formed on a photosensitive body and tracking members located on ends of the developing member that come into contact with the photosensitive body to make a distance between the developing member and the photosensitive body constant;

a revolver that rotates while holding the plurality of developing units;

each of the plurality of developing units is held to the revolver by a support member that protrudes from one of the revolver and the developing units, and by an elongated hole formed in the other of the revolver and the developing units and through which the support member is inserted such that each of the plurality of developing units is movable relative to the revolver in an approximately radial direction of the revolver; and a spacer mounted between the elongated hole and the support member to define a distance between one end of the elongated hole and the support member to adjust positions where the tracking members start contacting with the photosensitive body.

6. A rotary developing device according to claim 5, wherein a plurality of said spacers which differ in thickness are provided.

7. A rotary developing device according to claim 5, wherein a thickness of said spacer can be determined while being mounted between the support member and the elongated hole.

8. A rotary developing device according to claim 5, wherein said spacer is provided with an elastically deformable pawl piece which is engaged with said developing unit.

9. A rotary developing device according to claim 5, wherein said spacer is provided with a peripheral wall which comes into contact with and surrounds an outer peripheral portion of said elongated hole.

10. A rotary developing device according to claim 5, wherein a mounting and dismounting position of the spacer is located at a replacement position of a toner cartridge of the plurality of developing units.

11. A rotary developing device according to claim 5, wherein the spacer is replaceably mounted between the support member and the elongated hole.

* * * * *